US006709366B2

(12) United States Patent
Chuang

(10) Patent No.: US 6,709,366 B2
(45) Date of Patent: Mar. 23, 2004

(54) STEPPING EXERCISER HAVING SIMPLIFIED SUPPORT

(76) Inventor: Jin Chen Chuang, No. 17, Lane 301, Nan Yang Road, Fong Yuan, Taichung Hsien (TW), 420

( * ) Notice: Subject to any disclaimer, the term of this patent is extended or adjusted under 35 U.S.C. 154(b) by 72 days.

(21) Appl. No.: 10/144,218

(22) Filed: May 14, 2002

(65) Prior Publication Data

US 2003/0216224 A1 Nov. 20, 2003

(51) Int. Cl.[7] ..... A63B 22/04
(52) U.S. Cl. ..... 482/53; 482/909
(58) Field of Search ..... 482/51–53, 909, 482/57–65, 70–73

(56) References Cited

U.S. PATENT DOCUMENTS 5,232,421 A * 8/1993 Chen et al. ..... 482/53
5,256,118 A * 10/1993 Chen ..... 482/53
5,277,677 A * 1/1994 Terauds ..... 482/53
5,348,520 A * 9/1994 Chang ..... 482/52
5,505,678 A * 4/1996 Johnston ..... 482/52
5,518,470 A * 5/1996 Piaget et al. ..... 482/51
5,628,709 A * 5/1997 Chen ..... 482/53
6,224,515 B1 * 5/2001 Chen ..... 482/53

* cited by examiner

*Primary Examiner*—Stephen R. Crow
(74) *Attorney, Agent, or Firm*—Charles E. Baxley

(57) ABSTRACT

A stepping exerciser includes a post extended from a base, a pair of foot pedals pivotally secured to the post with a pivot axle and movable up and down relative to the base about the pivot axle, a shaft rotatably secured to the post and having an inner end disposed in the post and an outer end located outside the post, and a lever secured to the outer end of the shaft and having two ends disposed below and engaged with the bottom surfaces of the foot pedals. A counting device may be used for counting the rotational movement of the shaft relative to the post and the base.

6 Claims, 2 Drawing Sheets

STEPPING EXERCISER HAVING SIMPLIFIED SUPPORT

BACKGROUND OF THE INVENTION

1. Field of the Invention

The present invention relates to a stepping exerciser, and more particularly to a stepping exerciser including a simplified support for supporting the stepping exerciser.

2. Description of the Prior Art

Various kinds of typical stepping exercisers have been developed and used today, and include a pair of pivotal foot pedals attached to a base for allowing the foot pedals to be actuated or stepped and exercised by the users. One or more actuators or pneumatic or hydraulic cylinders are provided for coupling to the foot pedals and for applying the resistive force against the foot pedals. However, a complicated coupling device is required for coupling the actuators or the cylinders together, or for coupling the foot pedals for allowing the stepping operations of the exercisers to be connected together.

The present invention has arisen to mitigate and/or obviate the afore-described disadvantages of the conventional stepping exercisers.

SUMMARY OF THE INVENTION

The primary objective of the present invention is to provide a stepping exerciser including a simplified support for supporting and coupling the stepping operations of the foot pedals.

The other objective of the present invention is to provide a stepping exerciser including a simplified counter device for counting the stepping operations of the users.

In accordance with one aspect of the invention, there is provided a stepping exerciser comprising a base including a post extended therefrom, a pair of foot pedals pivotally secured to the post with a pivot axle, and movable upward and downward relative to the base about the pivot axle, the foot pedals each including a bottom surface, a shaft rotatably secured to the post and including an inner end disposed in the post, and an outer end located outside the post, a lever secured to the outer end of the shaft and including two ends disposed below and engaged with the bottom surfaces of the foot pedals respectively.

A device may further be provided for counting rotations of the shaft relative to the post. The lever and the shaft includes a simplified structure and may be rotatable relative to the post when the foot pedals are moved up and down relative to the base.

The counting means includes a first actuator member disposed in the post, and a second actuator member attached to the inner end of the shaft, and located close to the first actuator member, and movable across the first actuator member when the shaft is rotated relative to the post.

The counting means includes a processor device coupled to the first actuator member for detecting a relative movement between the first actuator member and the second actuator member, and thus for counting the movement between the actuator members.

The second actuator member is a magnetic member and attached to the inner end of the shaft. The shaft includes a stud provided on the inner end thereof for supporting the magnetic member.

The counting means includes a casing secured on the post, the first actuator member is secured to the casing. The casing includes a conduit extended therefrom the first actuator member is engaged in the conduit.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
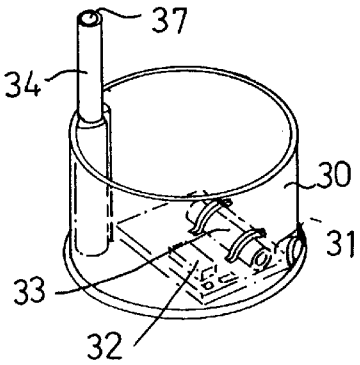
FIG. 2 is a bottom perspective view showing a counter device for the stepping exerciser.

Referring to the drawings, and initially to FIGS. 1–4, a stepping exerciser in accordance with the present invention comprises a base 10 including a post 11 extended upward from such as the front portion thereof, and a pair of foot pedals 12 including a front portion pivotally or rotatably secured to the post 11 with a pivot axle 14, for allowing the foot pedals 12 to be moved or stepped upward and downward relative to the base 10, about the pivot axle 14 as that of the typical stepping exercisers.

Figure 4:
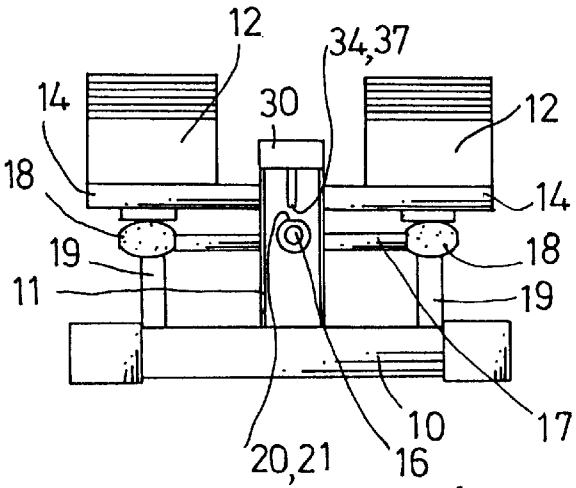
FIG. 4 is a front view of the stepping exerciser, in which a portion of the exerciser is cut off for showing the inner structure of the stepping exerciser.
Figure 3:
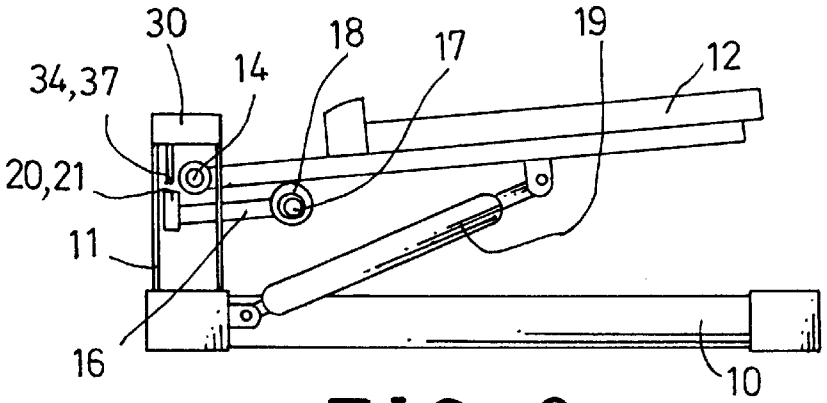
FIG. 3 is a side view of the stepping exerciser.

A shaft 16 is rotatably secured to the post 11, and preferably parallel to the foot pedals 12 when the foot pedals 12 are not being actuated and are located side by side, best shown in FIGS. 3 and 4. The shaft 16 includes one end engaged into the post. 11, and is preferably perpendicular to the post 11, but may be slightly inclined relative to the post 11 and the base 10, as also shown in FIG. 3. A lever 17 is secured to the other end or the outer end of the shaft 16 and preferably perpendicular to the shaft 16, and includes two ends each having a cushion or a pad 18 secured thereon for engaging with the bottom surfaces of the foot pedals 12 respectively, and for allowing the foot pedals 12 to be coupled together.

Figure 6:
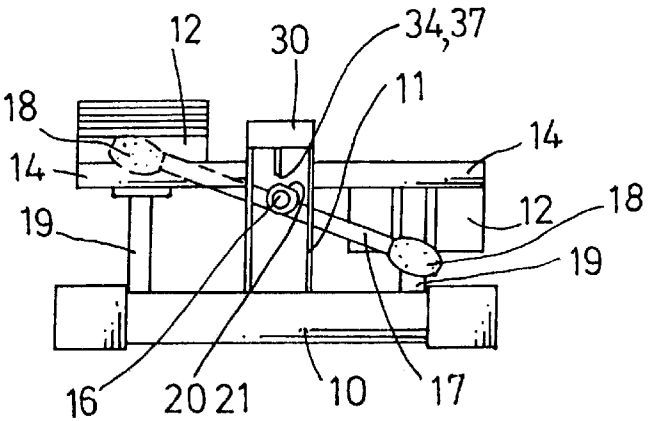
FIGS. 5 and 6 are front views similar to FIG. 4, illustrating the operation of the stepping exerciser.
Figure 5:
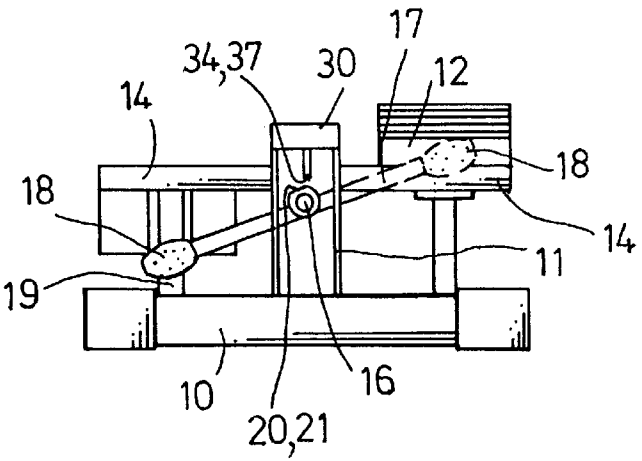

For example, as shown in FIGS. 3–6, when one of the foot pedals 12 is forced or stepped downward, the other foot pedal 12 may be caused to move upward by the lever 17; and vice versa, such that the foot pedals 12 may be actuated or operated or used to conduct the stepping exercises. One or more actuators 19 (FIGS. 1, 3) may further be provided and coupled to the foot pedals 12 respectively, for applying a resistive force against the foot pedals 12. As shown in FIGS. 4–6, the shaft 16 includes a stud 20 secured thereto, and located within the post 11, and preferably extended upward from the shaft 16. An actuator member, such as a magnetic member 21 is disposed in the stud 20 or directly secured to the shaft 16.

Figure 1:
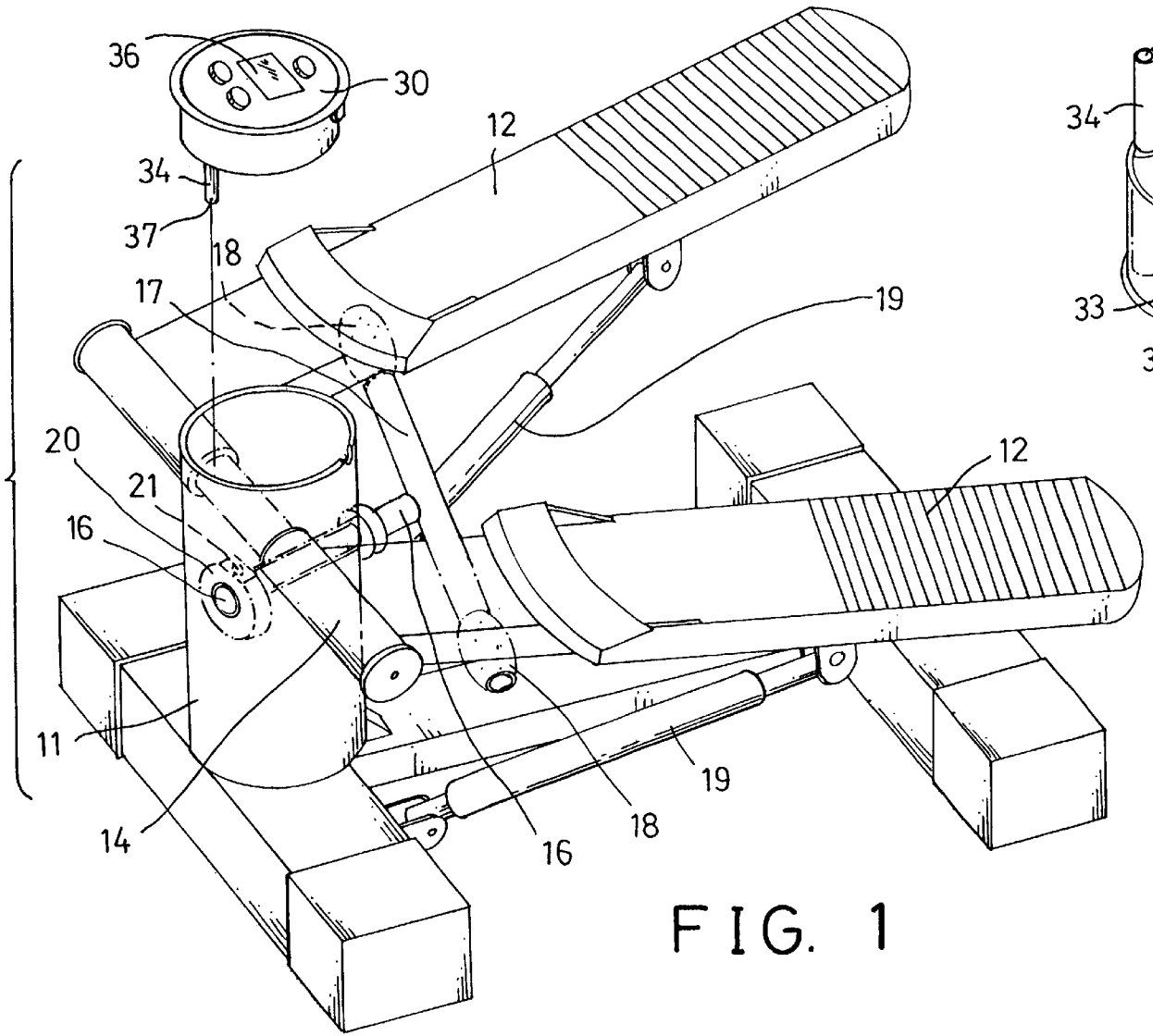
FIG. 1 is a partial exploded view of a stepping exerciser in accordance with the present invention.

As shown in FIGS. 1 and 2, a counting device may further be provided and includes a casing 30 for securing on top of the post 11 with fasteners or the like. A circuit board 31 is disposed or secured in the casing 30 with such as the fasteners, and includes a number of electric elements 32 secured thereon, such as the resistors, the capacitors (not shown), the integrated circuits, and/or the processor devices 32, and the like and one or more batteries 33 attached thereon and coupled to the electric elements 32 for energizing the electric elements 32.

The casing 30 further includes a conduit 34 extended therefrom, and preferably extended downward beyond the casing 30, and may include a screen or a displayer device 36 (FIG. 1) provided thereon for displaying purposes. It is to be noted that the casing 30 as shown in FIG. 2 is disposed up-side-down, for showing the inner structure thereof. A probe or a conductor or a detector or a sensor or an actuator member 37 may further be provided and engaged in the conduit 34 and electrically coupled to the circuit board 31. As best shown in FIGS. 4–6, the actuator member 37 is arranged above the magnetic member 21 for being actuated by the magnetic member 21.

In operation, as shown in FIGS. 3–6, when one of the foot pedals 12 is depressed downward and the other foot pedal 12 is moved upward, the magnetic member 21 may be disengaged or offset from the actuator member 37. When the other foot pedals 12 is depressed downward, the magnetic member 21 may be rotated and caused to be moved across or bypass the actuator member 37, in order to actuate the actuator member 37 to generate a signal or to actuate the integrated circuits, and/or the processor devices, and so as to count the stepping exercises of the users.

It is to be noted that the stepping exercisers includes a simplified support having the lever 17 secured to the shaft 16 for engaging and supporting the foot pedals 12, and for coupling the foot pedals 12 together. The shaft 16 and the lever 17 that are stably and rotatably secured to the post 11 may also be used to form the counting structure having the magnetic member 21 disposed on the shaft 16 and movable relative to the actuator member 37 in order to count the stepping exercises of the users. The counted signals or information may be displayed on the displayer device 36 of the casing 30. The actuator member 37 may also be directly secured to the post 11 without the casing 30, and may be disposed beside or below the shaft 16 and/or the magnetic member 21, or disposed close to the magnetic member 21.

Accordingly, the stepping exerciser in accordance with the present invention includes a simplified support for supporting and coupling the stepping operations of the foot pedals and includes a simplified counter device for counting the stepping operations of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base including a post extended therefrom, a pair of foot pedals pivotally secured to said post with a pivot axle, and movable upward and downward relative to said base about said pivot axle, said foot pedals each including a bottom surface, a shaft rotatably secured to said post and including an inner end disposed in said post, and an outer end located outside said post, a lever secured to said outer end of said shaft and including two ends disposed below and engaged with said bottom surfaces of said foot pedals respectively, said lever and said shaft being rotatable relative to said post when said foot pedals are moved up and down relative to said base, and means for counting rotations of said shaft relative to said post, said counting means including a first actuator member disposed in said post, and a second actuator member attached to said inner end of said shaft, and rotated together with said shaft, and located close to said first actuator member, and movable across said first actuator member when said shaft is rotated relative to said post.

2. The stepping exerciser according to claim 1, wherein said counting means includes a processor device coupled to said first actuator member for detecting a relative movement between said first actuator member and said second actuator member.

3. The stepping exerciser according to claim 2, wherein said second actuator member is a magnetic member and attached to said inner end of said shaft.

4. The stepping exerciser according to claim 3, wherein said shaft includes a stud provided on said inner end thereof for supporting said magnetic member.

5. The stepping exerciser according to claim 1, wherein said counting means includes a casing secured on said post, said first actuator member is secured to said casing.

6. The stepping exerciser according to claim 5, wherein said casing includes a conduit extended therefrom, said first actuator member is engaged in said conduit.

* * * * *